US009868051B2

(12) United States Patent
Kolb

(10) Patent No.: US 9,868,051 B2
(45) **Date of Patent: *Jan. 16, 2018**

(54) TABLE/PARLOUR FOOTBALL

(71) Applicant: Justin Kolb, Castle Rock, CO (US)

(72) Inventor: Justin Kolb, Castle Rock, CO (US)

( * ) Notice: Subject to any disclaimer, the term of this patent is extended or adjusted under 35 U.S.C. 154(b) by 105 days.

This patent is subject to a terminal disclaimer.

(21) Appl. No.: 14/583,092

(22) Filed: Dec. 24, 2014

(65) Prior Publication Data

US 2015/0217184 A1 Aug. 6, 2015

Related U.S. Application Data

(63) Continuation-in-part of application No. 13/567,009, filed on Aug. 3, 2012, now Pat. No. 8,944,435.

(60) Provisional application No. 61/515,551, filed on Aug. 5, 2011.

(51) Int. Cl.

| | |
|---|---|
| ***A63F 7/06*** | (2006.01) |
| ***A63F 7/07*** | (2006.01) |
| ***A63F 7/20*** | (2006.01) |
| ***A63F 3/00*** | (2006.01) |
| ***A63F 7/00*** | (2006.01) |

(52) U.S. Cl.

CPC ..... *A63F 3/00041* (2013.01); *A63F 3/00031* (2013.01); *A63F 3/0052* (2013.01); *A63F 7/0005* (2013.01); *A63F 2003/00034* (2013.01); *A63F 2003/00287* (2013.01)

(58) Field of Classification Search

CPC ..... A63F 3/00041; A63F 3/00031; A63F 2003/00287; A63F 2003/00034; A63F 3/0052; A63F 7/0005

USPC ..... 273/317.4, 108.4, 108.41, 288–291; 473/10; 116/225

See application file for complete search history.

(56) References Cited

U.S. PATENT DOCUMENTS

| | | | | |
|---|---|---|---|---|
| 1,693,277 | A | 11/1928 | Hustwick | |
| 2,140,193 | A | 12/1938 | Weinberger | |
| 2,727,744 | A | 12/1955 | Watson | |
| 2,760,776 | A | 8/1956 | Tullio | |
| 2,784,970 | A * | 3/1957 | Heiner | A63F 3/00041 116/225 |
| 3,379,441 | A | 4/1968 | Feather et al. | |
| 3,554,548 | A * | 1/1971 | Isom | A63F 7/06 273/143 R |
| 3,690,668 | A | 9/1972 | Weeks et al. | |
| 3,724,852 | A | 4/1973 | Payne, Jr. | |
| 3,784,204 | A | 1/1974 | Felber | |
| 3,817,529 | A | 6/1974 | Dobbins | |
| 3,995,863 | A * | 12/1976 | Cummins | A63F 3/00041 273/247 |
| 4,034,985 | A * | 7/1977 | Breslow | A63F 7/386 138/151 |

(Continued)

*Primary Examiner* — Sebastiano Passaniti

(74) *Attorney, Agent, or Firm* — Faegre Baker Daniels LLP

(57) ABSTRACT

A table includes a table surface, a border, and an underside. A planar game board is disposed within the table, wherein the planar surface includes a plurality of scoring targets and a plurality of zones marked thereon. A simulated American football field piece is secured to the planar game board, so that playing pieces may pass underneath, across, over, or above the planar surface and simulated American football field piece. Play-indicating mechanisms are attached to the table. The play-indicating mechanisms are each configured to indicate one of a plurality of play options.

20 Claims, 13 Drawing Sheets

(56) References Cited

U.S. PATENT DOCUMENTS

| | | | | | |
|---|---|---|---|---|---|
| 4,681,325 | A * | 7/1987 | Sheem | A63F 9/0208 | 273/317.5 |
| 4,762,323 | A * | 8/1988 | Blagg | A63F 7/0668 | 273/108.4 |
| 5,333,879 | A * | 8/1994 | Barnes | A63B 63/007 | 273/400 |
| 5,664,782 | A * | 9/1997 | Lacks | F41J 3/0028 | 273/317.5 |
| 5,733,213 | A | 3/1998 | Colarusso | | |
| 6,899,331 | B1 * | 5/2005 | Beyazbayrak | A63F 7/06 | 273/239 |
| 8,944,435 | B2 * | 2/2015 | Kolb | A63F 3/0052 | 273/108.4 |
| 2003/0030218 | A1 * | 2/2003 | Zucchi | A63B 63/00 | 273/371 |
| 2005/0073092 | A1 * | 4/2005 | Oister | A63F 7/025 | 273/119 R |
| 2006/0055106 | A1 | 3/2006 | Cohen | | |
| 2011/0148036 | A1 | 6/2011 | Nolen | | |
| 2015/0328515 | A1 * | 11/2015 | Prendergast | A63B 67/06 | 273/400 |

* cited by examiner

TABLE/PARLOUR FOOTBALL

CROSS-REFERENCE TO RELATED APPLICATIONS

This application is a continuation-in-part of U.S. application Ser. No. 13/567,009, filed Aug. 3, 2012, which claims the benefit of U.S. Provisional Application No. 61/515,551, filed on Aug. 5, 2011. Each of the aforementioned applications is hereby incorporated herein by reference in its entirety for all purposes.

BACKGROUND

Other inventions such as U.S. Pat. Nos. 5,570,888; 1,145,955; and U.S. Pat. Publication No. 2011/0031691 contemplate utilizing and manipulating various mechanical devices, figures, and/or playing pieces on a simulated American football field playing surface in an attempt to interact with and advance a football game piece across the field of play in an effort to simulate the game of American football. U.S. Pat. No. 7,775,525 describes a user tossing objects through targets on an interchangeable board (with overlaying templates representing various sports) with the goal of scoring points or achieving other metrics related to the given sport on the board.

SUMMARY

Embodiments of the present invention are designed based on American football. Embodiments may include a long and smooth wooden table, on which players slide a playing piece (referred to herein as a "puck") towards a scoring zone in which there are targets marked with combinations of yardage gain, yardage loss, turnover scoring indicators, and/or the like. An attached, simulated American football field playing surface may be employed as a yard-marking, scoring, and/or down-marking device.

Embodiments of the present invention combine the enjoyment and ease found in other parlour games such as billiards, shuffleboard, foosball, and air hockey with the strategy of American football. In embodiments, the objective of the game is to move (e.g., toss, fling, throw, and/or otherwise project) a puck down a long, smooth planar surface game board into a scoring zone in which there are targets marked with various "points" that equate to yardage gained or lost on the turn, and/or "down." In embodiments, the planar surface may be made of wood and covered in felt or other similar material. As the players tally yards on attempts, the down, yardage gained or lost, position on the field, and/or score may be tracked on a simulated American football field playing surface which may be secured on top of, within, adjacent to, and/or integrated into (e.g., as part of) the game board so that the game pieces may pass underneath, over, and/or through the simulated American football field playing surface.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1A:
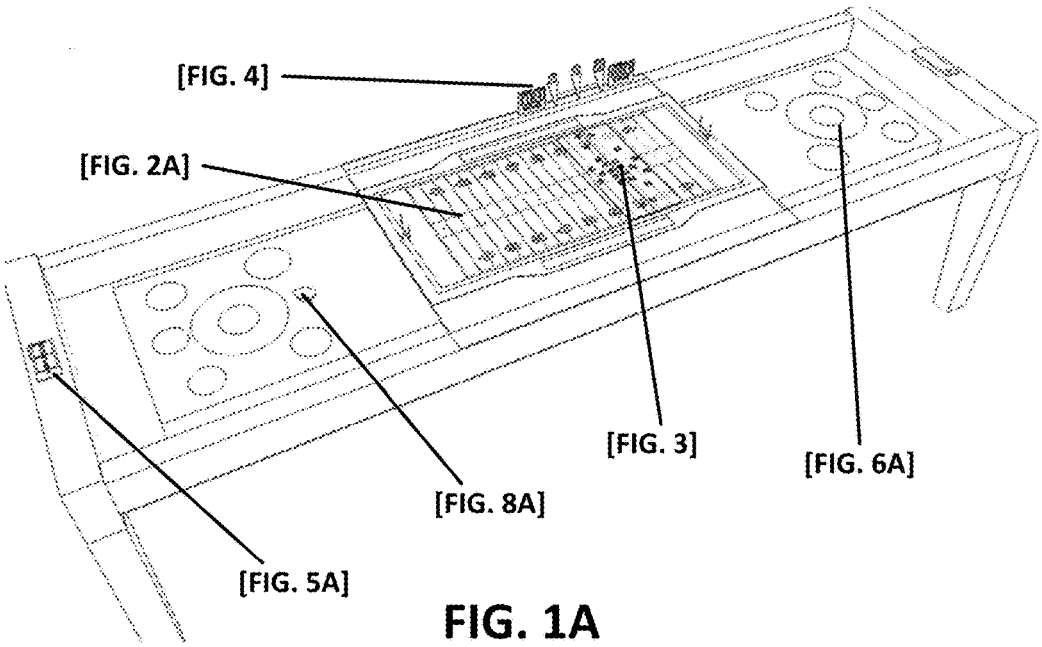
FIG. 1A is an angled overhead perspective view of a game table, having a planar playing surface with yardage scoring targets/zones, a replicated football field surface which is secured across and to the top of the game table, a line of scrimmage tracking piece (referred to as "XO player piece"), down markers, yardage markers, score indicators, and a playing football puck, in accordance with embodiments of the present invention.
Figure 1B:
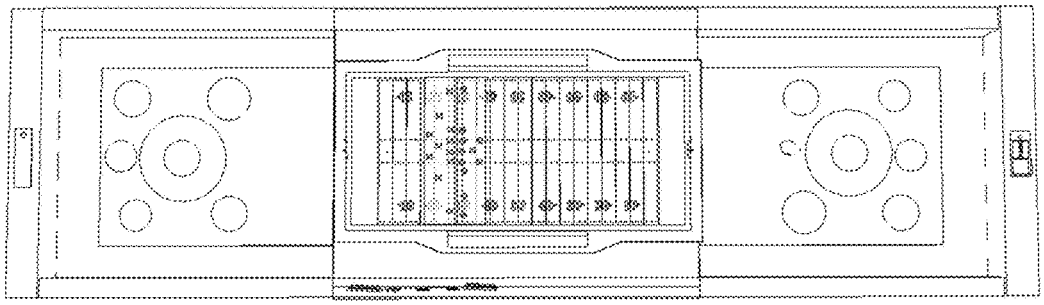
FIG. 1B is a direct overhead perspective view showing the same items indicated in FIG. 1A, in accordance with embodiments of the present invention.
Figure 1C:
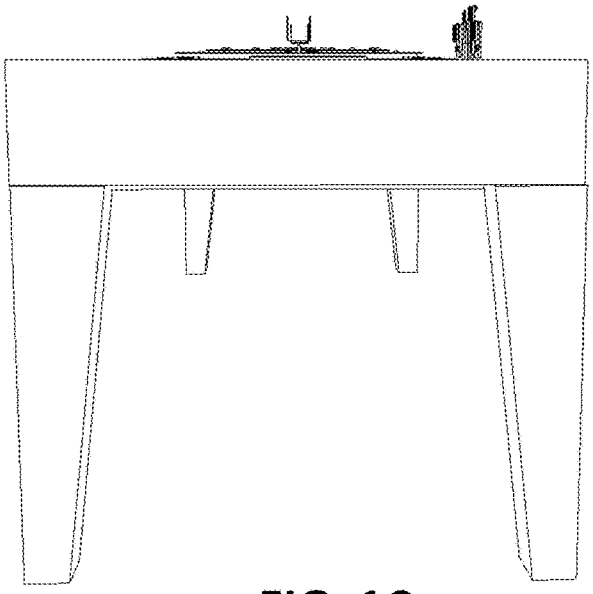
FIG. 1C is an end view of a game table with the legs extending downward, in accordance with embodiments of the present invention.
Figure 1D:
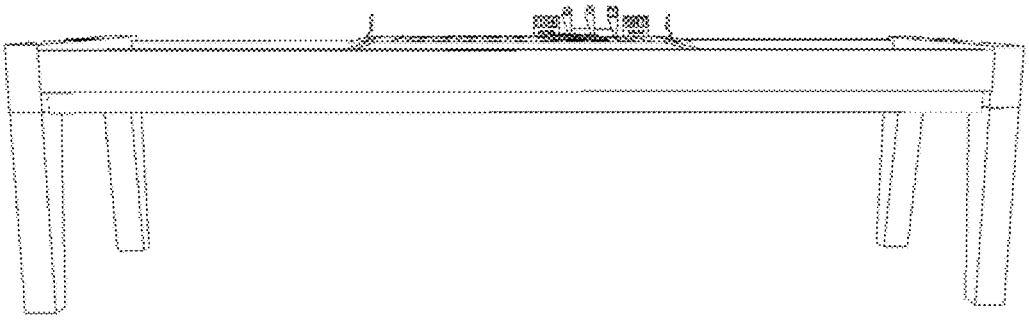
FIG. 1D is a side view of a game table with the legs extending downward, in accordance with embodiments of the present invention.
Figure 1E:
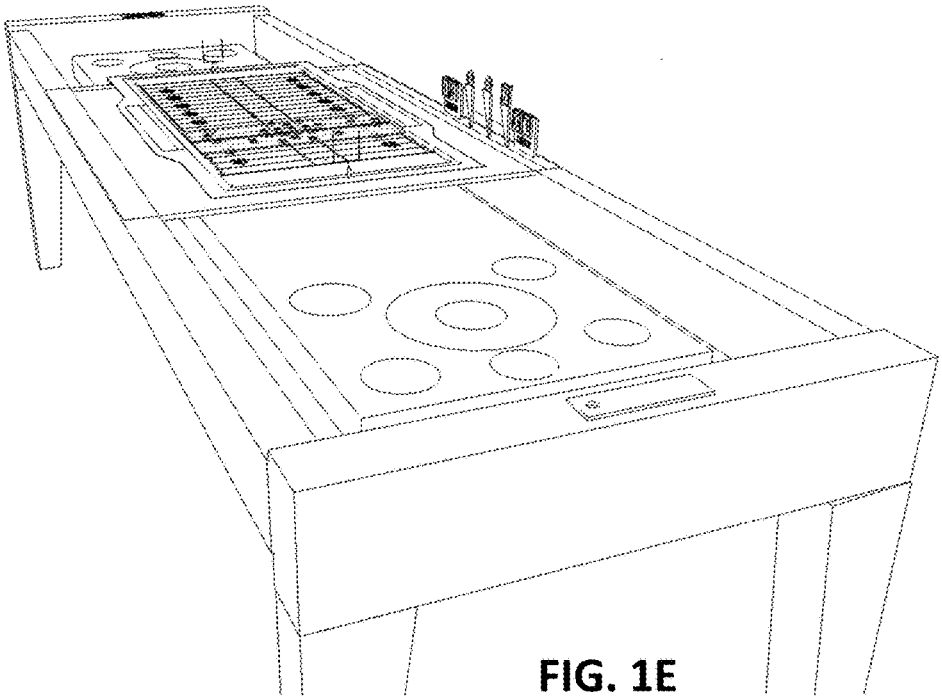
FIG. 1E is an angled, overhead end view perspective of the game table, shown in FIG. 1A, showing the placement of a replicated football field surface on top of the game table, in accordance with embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Embodiments of the present invention include a sporting game apparatus that incorporates the strategy of American football into a recreational parlour game, such as shuffle board, billiards, foosball or air hockey. As depicted in FIGS. 1A-1E, embodiments of the device may be crafted by constructing a table like structure, approximately 7 feet long by 3½ feet wide, although other proportions may be crafted without altering the general intent of embodiments of the invention. Within the table is a planar surface, also constructed out of wood or other sturdy, supportive material that is fastened to the table by a means known to those skilled in the art, and rises (e.g., approximately 3 inches) from the table surface. In embodiments, a border, that may be of similar rise, is constructed around the table. The top of the planar surface can be covered in wood, laminate, felt, or other material without altering the overall concept of embodiments of the invention. As shown, in embodiments, on the underside of the table are cross-braces and a supporting structure (e.g., two, three, four, or more legs), which may, for example, include four legs, one at each corner of the game board, extending down from, and securely fastened to the table by screws or other similar fastening means know in the art, that may provide for a stable, level playing surface and elevate the game board off the ground. Other designs for the table support structure can also be configured, with or without legs, without changing the overall scope or intent of embodiments of the invention.

Figure 2A:
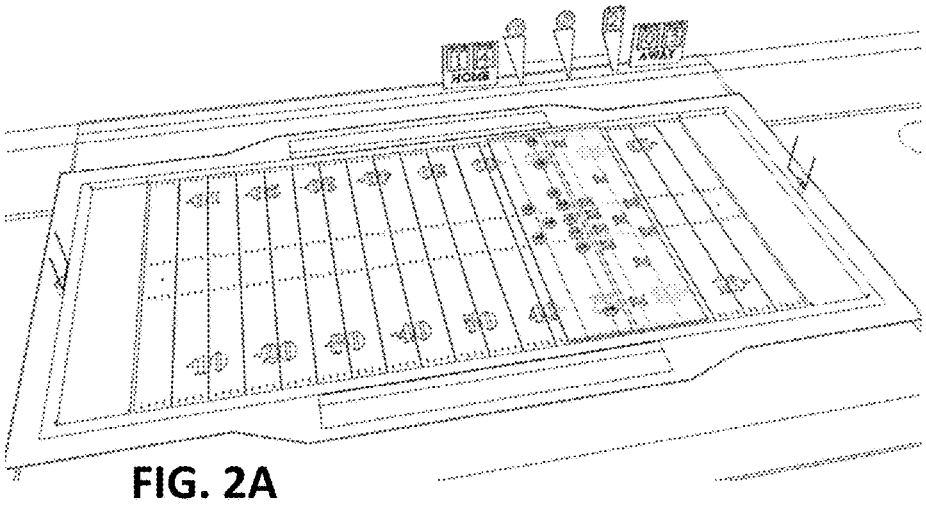
FIG. 2A is an exploded view of a simulated football field piece, also showing closer views of down markers, yard markers, score indicators and an XO player piece, in accordance with embodiments of the present invention.

As depicted in FIG. 2A, a piece made of wood, laminate, plastic, metal, or other rigid material, painted, printed, or covered in a material designed and marked to scale to represent an American football field may be fastened across the middle of the game table described above. In embodiments, on this field piece are model goal posts and end zone marking pylons, representative of those that are found on an actual football field and crafted by those skilled in the art of creating such scaled model or toy equipment pieces.

Figure 10:
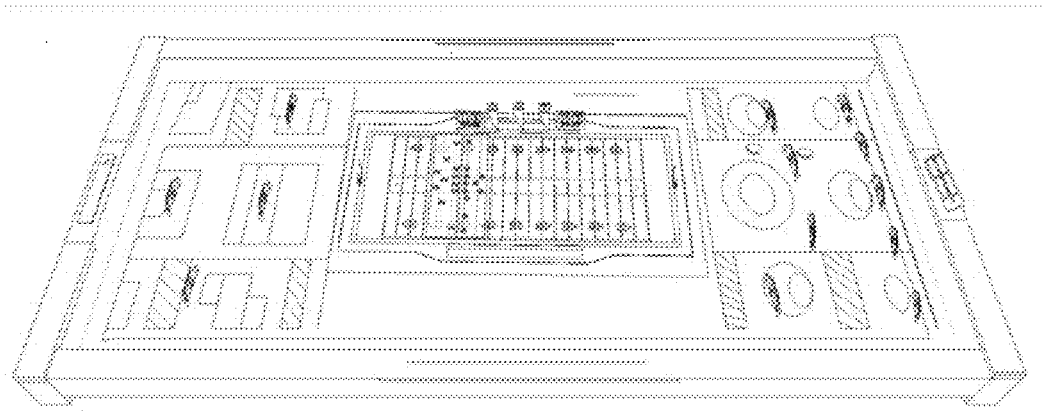
FIG. 10 is an angled, overhead view of an alternative configuration showing the American football field piece secured within the planar game board, so that playing pieces may pass across, above, or over the simulated American football field and planar game board, in accordance with embodiments of the present invention.
Figure 11:
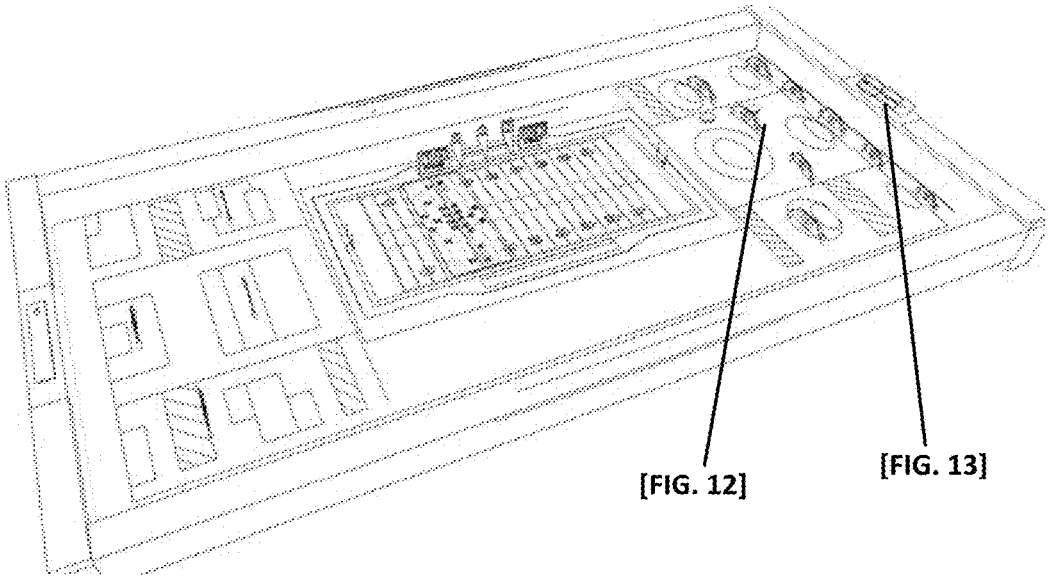
FIG. 11 is another angled, overhead view of an alternate configuration showing the American football field secured within the planar game board, in accordance with embodiments of the present invention.
Figure 12:
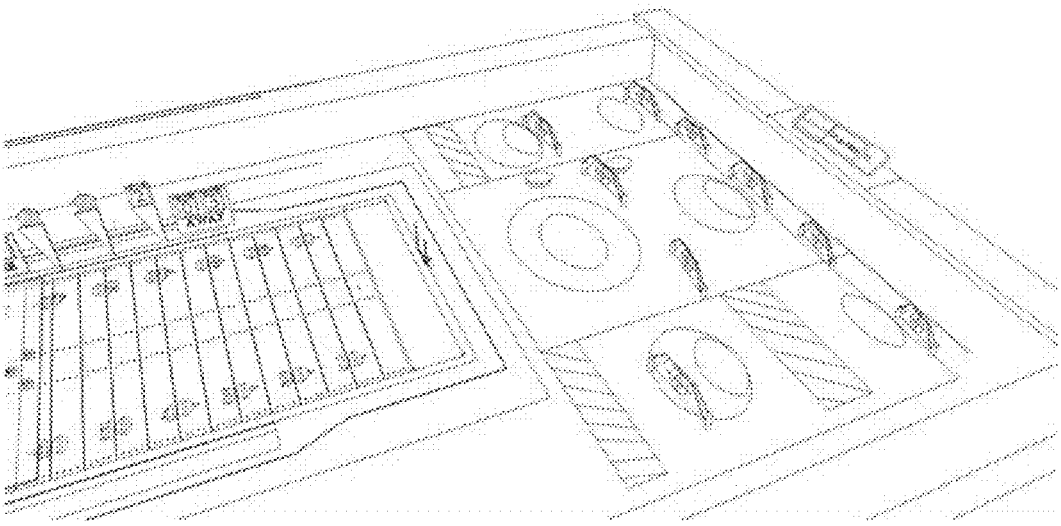
FIG. 12 is an exploded angled top view showing an alternate configuration depicting upright, adjustable scoring targets affixed to said plurality of targets and zones on planar surface, or otherwise designed into game table, wherein each of said upright scoring targets represents a number of yards gained or lost, in accordance with embodiments of the present invention.

In embodiments, as depicted in FIG. 10 and FIG. 11, the American football field piece may also be designed and secured into the planar game board. That is, for example, the planar game board may include a recess within which the American football field piece may be positioned. In embodiments, the American football field piece may be, in whole or in part, integrated within the planar game board, painted on the planar game board, and/or the like.

Figure 2B:
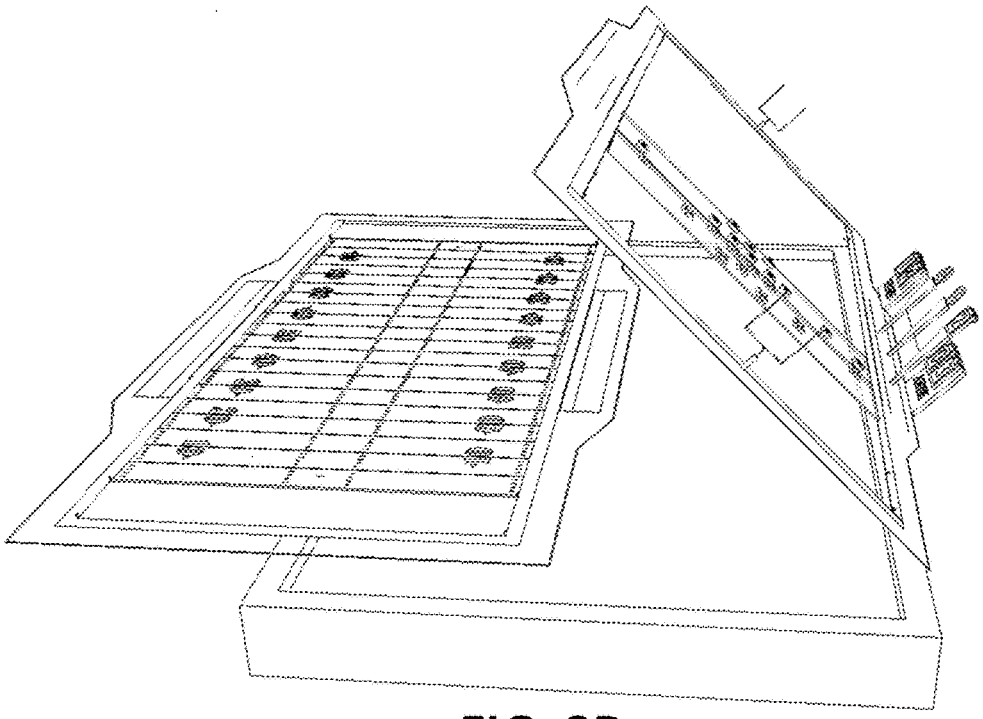
FIG. 2B is an exploded view of a base into which a simulated American football field is placed, with a lid piece to which goal posts, an XO player piece, yard markers, down marker and score indicators attached in the open position, and showing said field simulated being removed, in accordance with embodiments of the present invention.

As shown in FIG. 2B, in embodiments, the simulated football field piece may be comprised of a base with a lid into which said field component may be housed and secured. The lid may be fastened to the base in a manner known to those skilled in the art so that it can open and close securely, and the XO player piece, the yard markers, down marker, and scoreboard may be fastened to the perimeter of the lid component in a manner known to those skilled in the art that allows them to slide longitudinally down the lid. The field component can be removed and replaced with alternate simulated fields.

Additionally, the XO player piece, yard markers, down marker, and scoreboard may be fastened to a border area surrounding the American football field piece, or secured to other areas of the table, with or without a lid component, without changing the intent and scope of embodiments of the invention.

Figure 3:
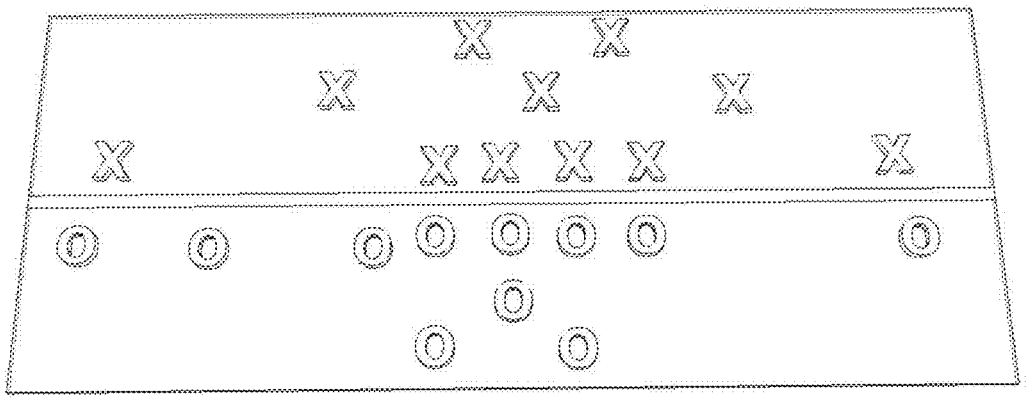
FIG. 3 is an exploded view of an XO player piece, in accordance with embodiments of the present invention.

As shown in FIG. 3, the XO player piece may be a rectangular plastic, or other lightweight transparent material, piece marked with "X"s and "O"s in a formation similar to that of players lined up on offensive and defensive positions on a football field, with a graphic line printed down the middle, between the X's and O's, representing the line of scrimmage in a football game that is used to represent from where the ball is snapped on a given down and play. It is understood that other formations or symbols can be utilized on the piece without altering the general scope of embodiments of the invention. This plastic piece may be sized to extend across the latitudinal length of the field piece described above and may be secured to such in a fashion so as to allow for the piece to slide over the field piece in a longitudinal direction so that the line of scrimmage indicator can align with the yard markers on the replicated football field piece.

Figure 4:
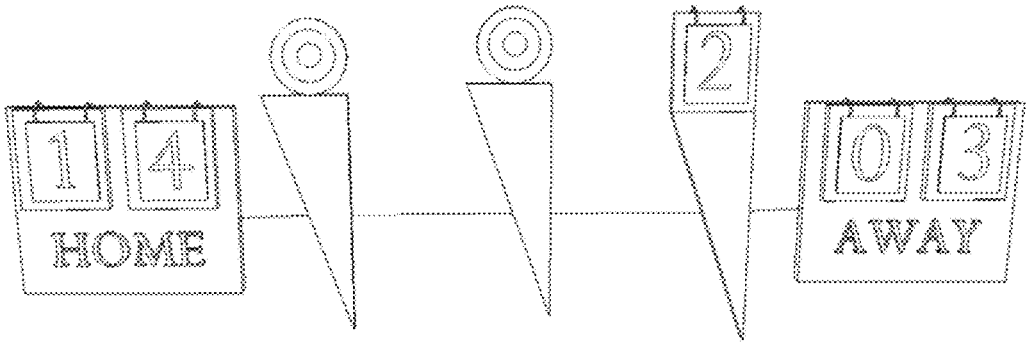
FIG. 4 is an exploded view of a down marker, yard markers, and score indicator piece, in accordance with embodiments of the present invention.

As shown in FIG. 4, the down markers may include a piece crafted of wood, plastic, or other sturdy material that is designed and scaled to represent the first down yard markers and down markers utilized on the sidelines in an actual football game. In embodiments, attached are two scoreboard pieces on which the score of the game for a "home" team and an "away" team can be tracked. The mechanism can be attached to either the game table or the field piece and fits into a grooved track that aligns with the yard markers on the replicated football field piece so that it can slide longitudinally down the field. The two yard markers may be placed apart from one another at a distance that represents 10 yards on the scaled, replicated football field and the piece may be designed so that players can move it longitudinally down the field to mark the distance at which a "first down" is achieved. Numbers on the down marker and scoreboards may be designed to rotate, flip, or otherwise change in a manner known to those skilled in the art so that the numbers 0 through 9 can be placed in each numerical location.

Figure 5A:
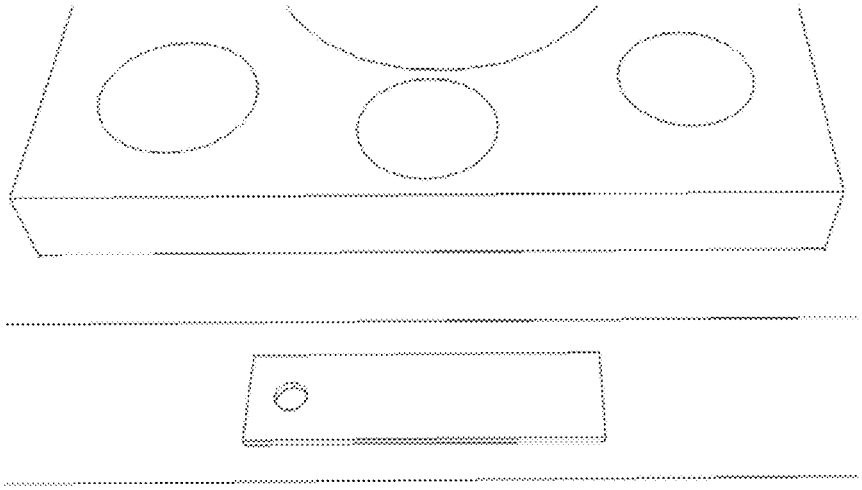
FIG. 5A is an exploded view of a "RUN/PASS" play indicator with the cover slide in the closed position, in accordance with embodiments of the present invention.
Figure 5B:
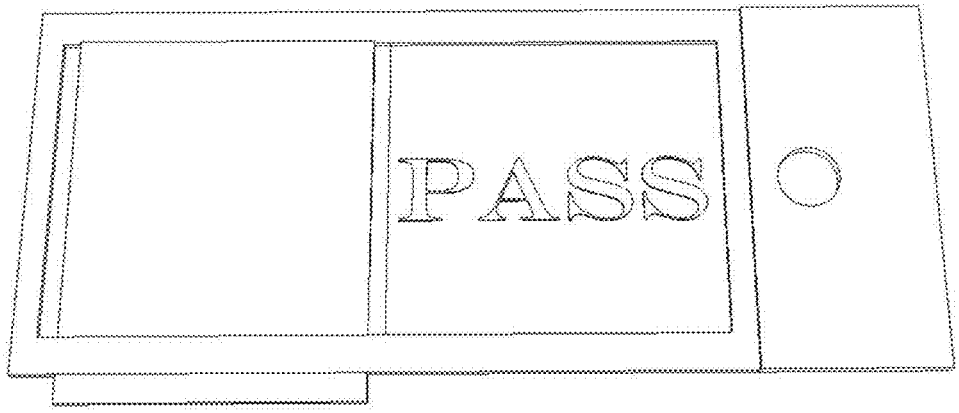
FIG. 5B is an exploded view of the "RUN/PASS" play indicator with the cover slide in the open position, and the inner slide covering the RUN selection, in accordance with embodiments of the present invention.
Figure 5C:
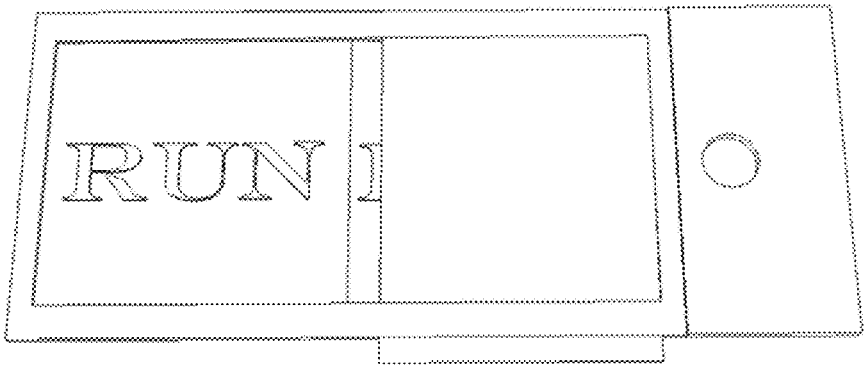
FIG. 5C is an exploded view of the "RUN/PASS" play indicator with the cover slide in the open position, and the inner slide covering the PASS selection, in accordance with embodiments of the present invention.

As shown in FIG. 5A, FIG. 5B, and FIG. 5C is a cover and slide mechanism designed into each end of the game table, in accordance with embodiments of the invention. The outer cover may be configured to slide into a receptacle designed into the table, and may be used as a lid to cover a "run/pass" indicator slide underneath. An inner cover slide is shown that may be used to then cover either the "run" or "pass" selection. Other methods or mechanisms of choosing "run" or "pass", or other play options, can also be designed into embodiments of the present invention without altering the general scope or intent.

Figure 13:
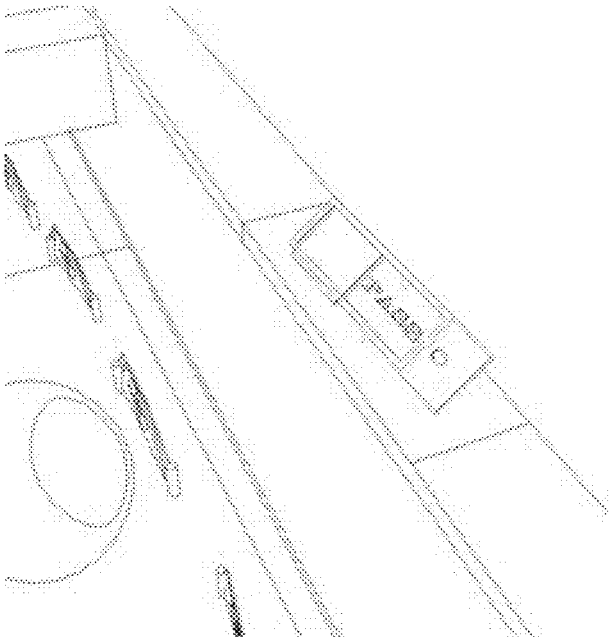
FIG. 13 is an exploded angled top view showing an alternate configuration of the play-indicating mechanism that can flip up, or otherwise be displayed so that a player on the alternate side can view the result, as opposed to the "sliding" version shown in FIGS. 5A, 5B, 5C, in accordance with embodiments of the present invention.

As an example, FIG. 13 shows an alternative version of the play-indicating mechanism that can flip up and down.

Figure 6A:
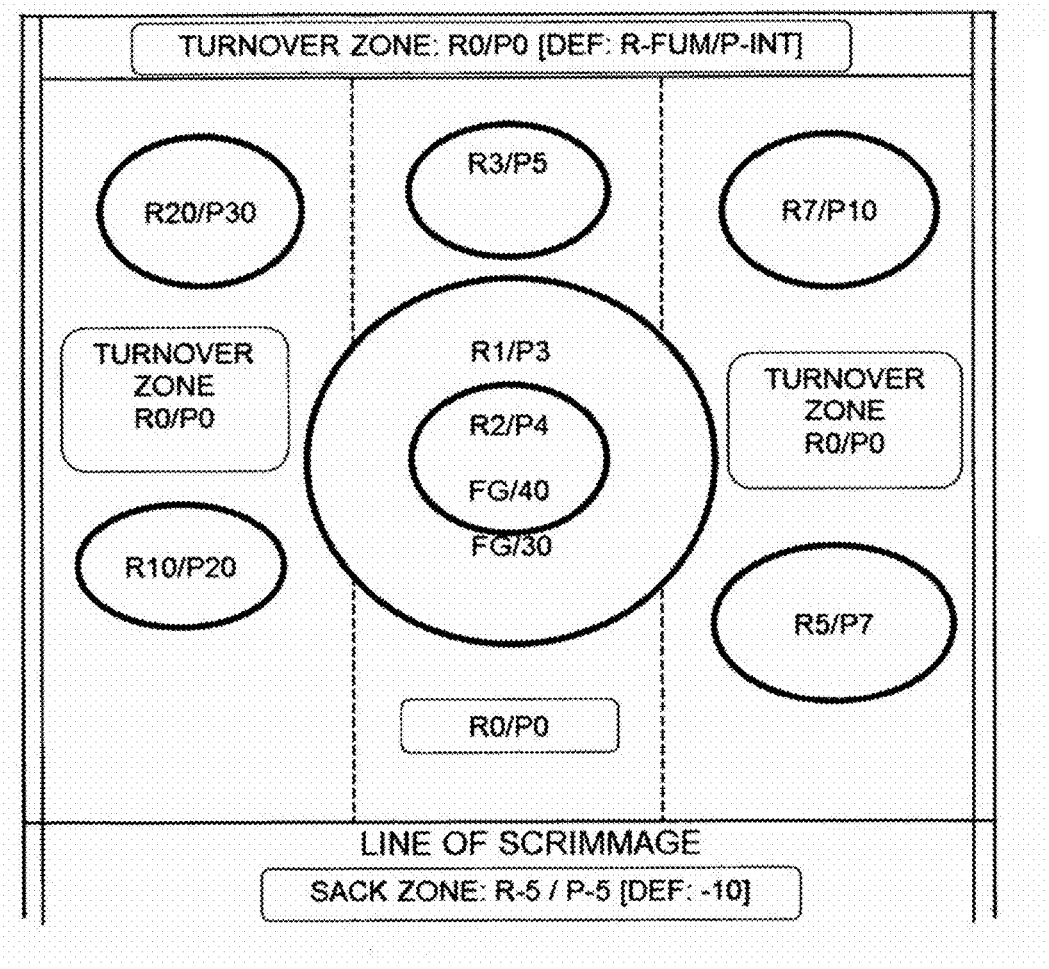
FIG. 6A is an exploded view of the scoring targets and zones on the planar playing surface, in accordance with embodiments of the present invention.
Figure 6B:
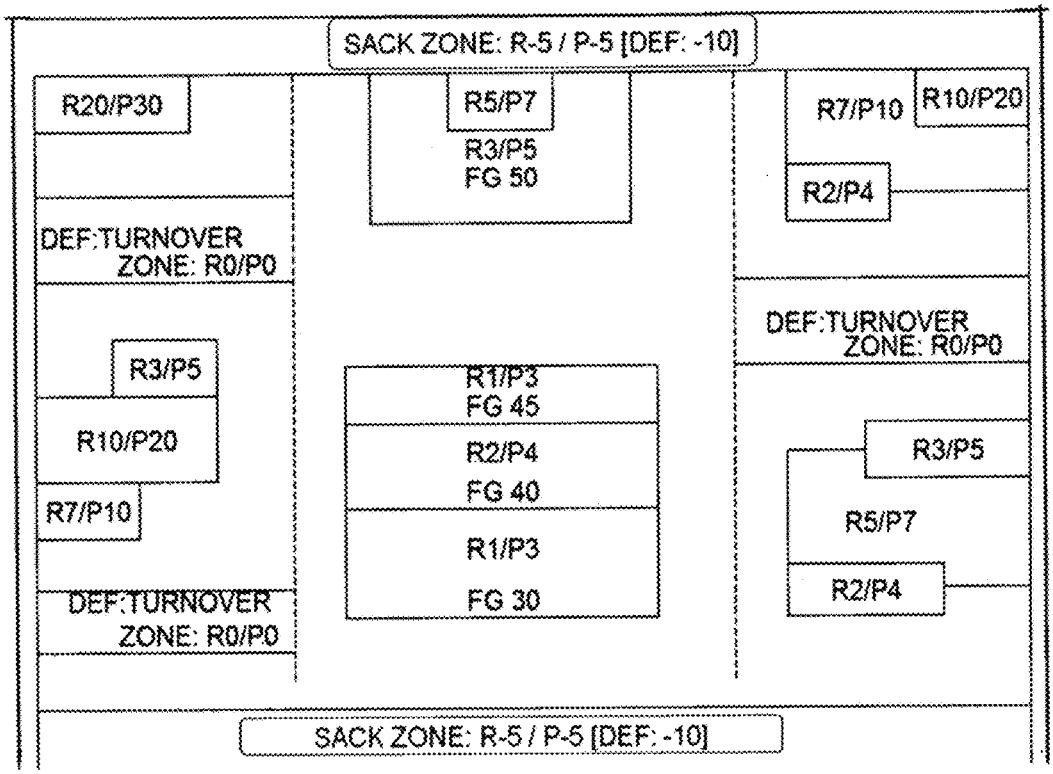
FIG. 6B is an exploded view of an alternate layout of the scoring targets and zones on the planar playing surface, in accordance with embodiments of the present invention.

As shown in FIG. 6A and FIG. 6B the graphics may be printed, painted, or otherwise designed on the wood, felt, laminate or other material utilized for the playing surface and may depict the scoring and yardage targets and zones. The scoring and yardage targets and zones are of varying sizes in order to create different degrees of difficulty that correspond to the points, yardage, or outcomes that can be obtained on an attempt by the player. In embodiments, scoring and yardage zones are shown as ovals and rectangles of differing sizes, with corresponding combinations of points representing variations of yardage gained or lost, however, other sizes and shapes of targets with other variations and combinations of scoring and events that can occur in a play, or down, of American football, located in other positions, can be utilized without altering the general scope of embodiments of the present invention.

Figure 14:
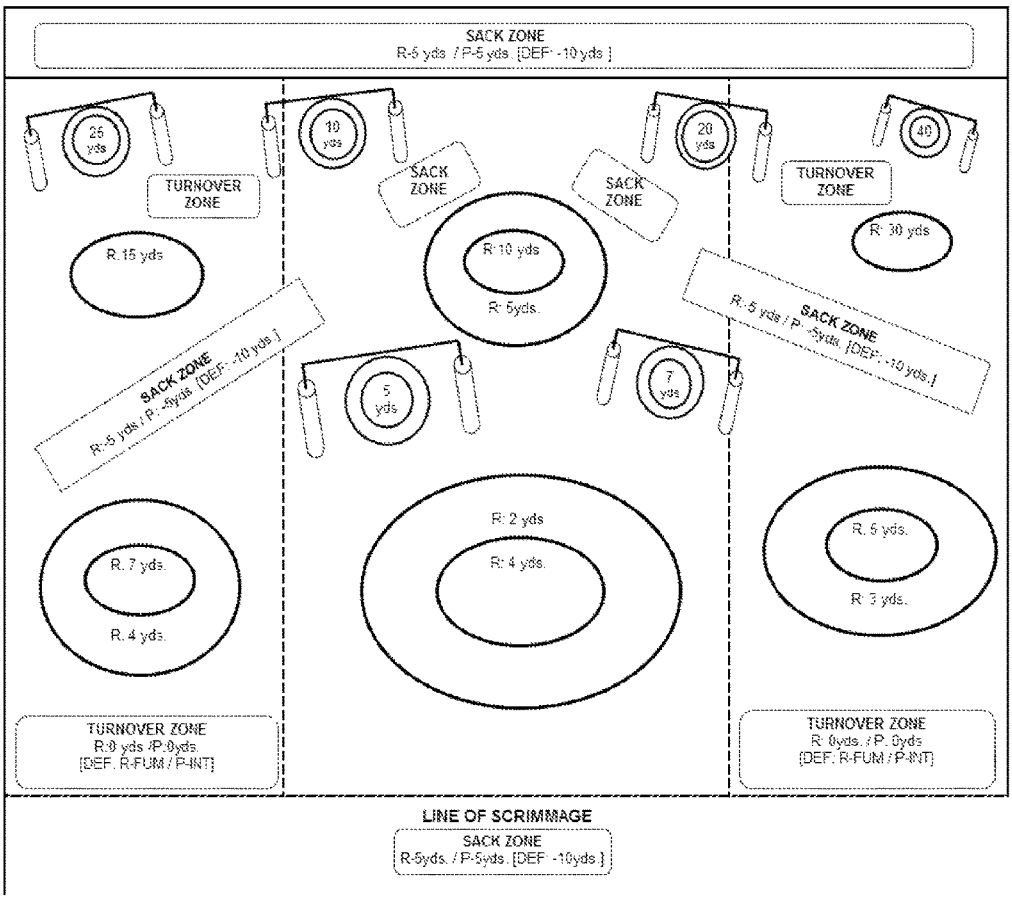
FIG. 14. is an exploded, overhead view showing an alternative configuration for upright, scoring targets, in accordance with embodiments of the present invention.

FIG. 14 shows an alternative configuration for upright targets with differing sizes, with corresponding combinations of points representing variations of yardage gained or lost; however, other sizes and shapes of targets with other variations and combinations of scoring and events that can occur in a play, or down, of American football, located in other positions, can be utilized without altering the general scope of embodiments of the present invention.

Figure 7:
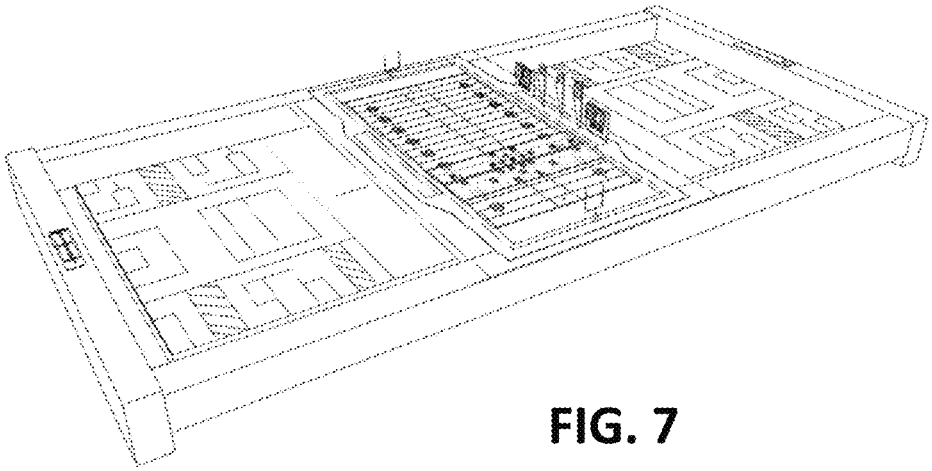
FIG. 7 is an angled overhead perspective of the present invention showing a modified form of the planar playing surface with the alternate scoring targets and zones indicated in FIG. 6B, and an alternate, perpendicular method of securing the simulated American football field to the playing surface, in accordance with embodiments of the present invention.

As displayed in FIG. 7, the present invention may also have the football field piece identified in FIGS. 2A and 2B secured perpendicularly across the game table. Additionally, FIG. 7 shows an alternative layout for the scoring and yardage targets and zones, as depicted in FIG. 6B.

Figure 8A:
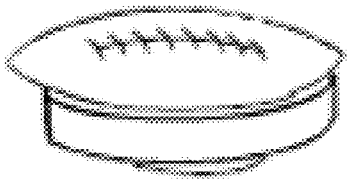
FIG. 8A is an exploded angled top view of the football shaped game piece with a housed rollerball underside, in accordance with embodiments of the present invention.
Figure 8B:
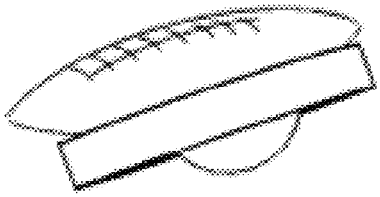
FIG. 8B is an exploded angled side perspective of the football shaped game piece with a housed rollerball underside, in accordance with embodiments of the present invention.

As shown in FIG. 8A, and FIG. 8B, a football-shaped playing piece may be crafted from metal and/or plastic and/or other sturdy material(s) know to those skilled in the art, attached firmly to an underlying metal, plastic, or other similar rigid material base, that is designed to securely house an internal rollerball, similar in size to a pinball, that allows said playing piece to roll across the playing surface.

Figure 8C:
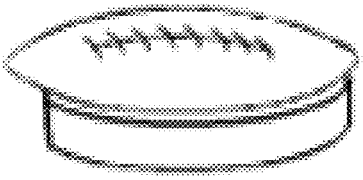
FIG. 8C is an exploded angled top view of the football shaped game piece with a smooth base, in accordance with embodiments of the present invention.
Figure 8D:
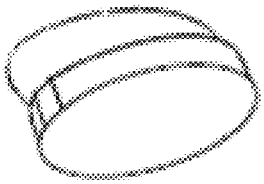
FIG. 8D is an exploded side perspective of the football shaped game piece with a smooth base, in accordance with embodiments of the present invention.
Figure 9:
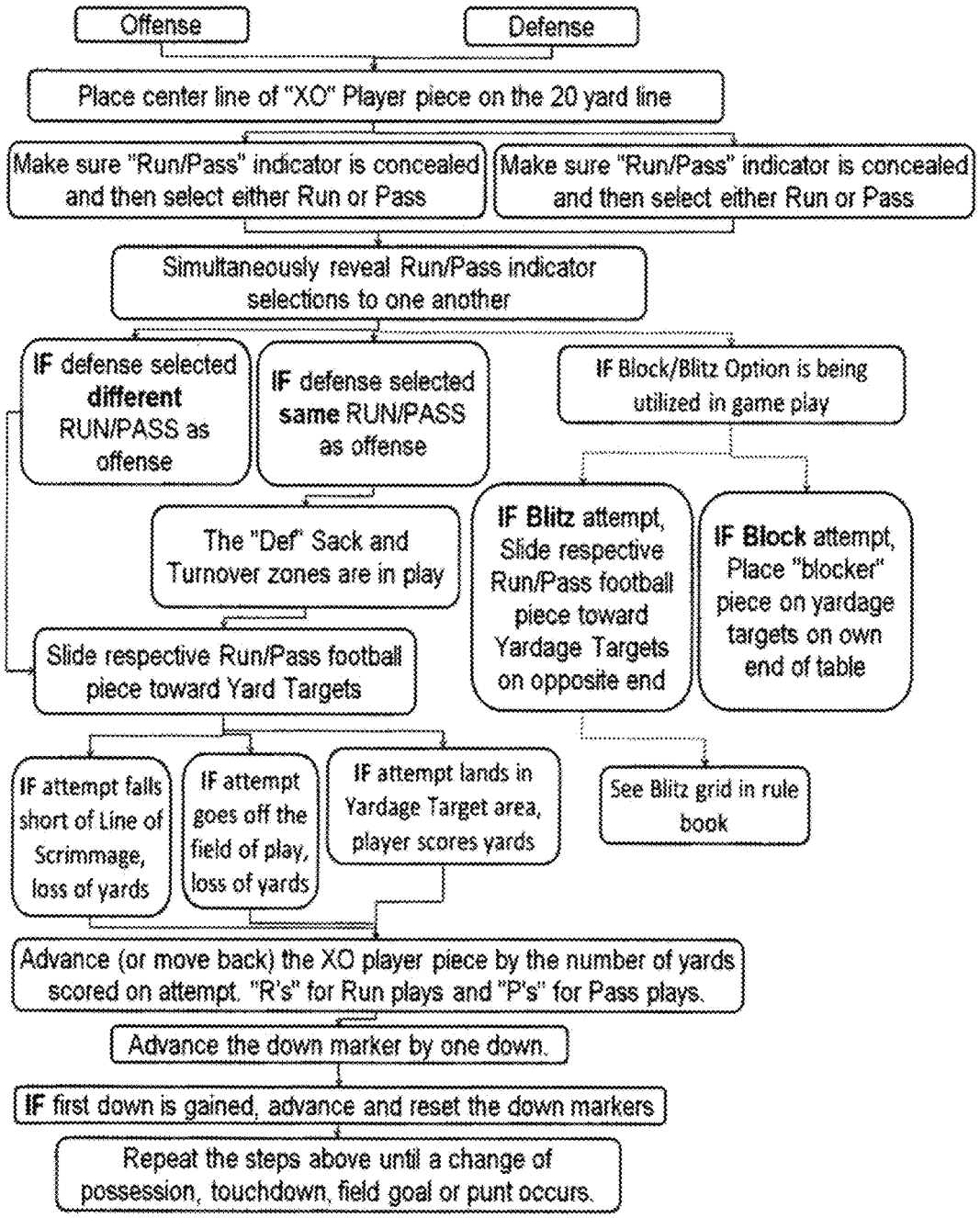
FIG. 9 is a flow chart that outlines a process for following a set of rules of the game, in accordance with embodiments of the present invention.

As shown in FIG. 8C, and FIG. 8D, a football-shaped playing piece may be crafted from metal and/or plastic and/or other sturdy material(s) know to those skilled in the art, and attached firmly to an underlying metal, or other similar rigid material, "puck"-like base that can also be football-shaped, circular, or other shape without altering the overall concept of embodiments of the invention. The football-shaped top of the playing pieces depicted in FIG. 8A and FIG. 8C may be about ¼ inch thick and approximately 3 inches long but could also be of different proportions without changing the overall concept of embodiments of the present invention. The underlying base components of the playing pieces identified in FIG. 8A and FIG. 8C are preferably 2 and ¾ inches in diameter and 1 and ½ inches thick, but could also be of different proportions without changing the overall concept of embodiments of the present invention.

According to embodiments, the general rules of the game are meant to correspond with the basic rules underlying the sport of American football and may include, for example, a set of rules as follows (though any number of other sets of rules, variations on the rules presented herein, and/or the like are contemplated within the ambit of embodiments of the invention):

Table Football is intended to simulate the strategy of football, with the play and outcome determine by a little bit of skill and a little bit of luck. The rules presented below are the standards, but adaptations that enhance the table football experience are welcomed.

1. LENGTH OF GAME: The game can be timed (ex. most points at the end of 30 minutes) or can be played as the first to a pre-determined number of points (ex. 21 pts.)
2. SCORING: Scoring is the same as real football, although no extra points or two point conversions are necessary (Touchdown—7pts., Field Goal—3 pts., Safety—2 pts.)
3. LINE OF SCRIMMAGE: At the beginning of the game and the end of any score, play begins on the 20 yard line. Slide the "XO" player piece so that the yellow "line of scrimmage" marker is centered on the 20 yard line.
4. PLAY SELECTION: Each play begins with each player concealing their "RUN/PASS" indicator and then selecting either RUN or PASS for the down. After each player is ready, lift the indicators simultaneously to reveal your selection. IF the defensive player has selected the same type of play for the down as the offensive player, then the "DEF" indicators in the SACK and TURNOVER zones are in play. (Also, see Block and Blitz rule below).
5. GAINING (OR LOSING) YARDS: The offensive player slides either the respective RUN or PASS football piece down the field toward the YARDAGE TARGETS to score yards, if successful on the attempt.
   a. The "R's" represent the number of yards by which to advance the XO player piece on a successful Run Play and the "P's" represent the number of yards by which to advance the XO player piece on a Pass Play.
   b. If the defensive player has correctly chosen the type of play for the given down, then the "DEF" options are in play in the SACK and TURNOVER zones.
   c. If the offensive player does not push the game piece past the LINE OF SCRIMMAGE, then a loss of yards results—the amount indicated in the Sack Zone box.
   d. If the offensive player pushes the football off the field of play, then a loss of yards result, as indicated in the Sack Zone box.
   e. Safety: If a SACK occurs, and it results in the offensive player having to move the XO player piece backwards into his own end zone, so that the line of scrimmage is behind the goal line, a SAFETY is awarded. After a safety, the defense scores 2 points and takes over possession on the 50 yard line.

f. If the game piece lands on a line, then the game piece is considered to be in the scoring area in which the majority of the game piece lies. If it is "50%/50%", then the game piece is considered to be in the scoring area most advantageous to the offensive player. However, each player is entitled to two challenges per game (see instructions below).

6. "MOVING THE CHAINS": At the end of each play, the DOWN MARKER is advanced by one down and the XO player piece is advanced by the number of successful yards scored (based on the position of the yellow line of scrimmage). On a first down, or during a change of possession, advance/reset the first down markers, just as in real football, in order to correctly relocate the 10 yard marker.
7. 4TH DOWN: On fourth down, the offensive player can elect to "go for it", punt, or kick a field goal. On a missed field goal or an unsuccessful attempt for a first down (or TD) on fourth down, a change of possession results, and the defensive player takes over at the line of scrimmage.
8. SCORING: When the attempt of sliding the game piece into a YARDAGE TARGET on a down results in the successful advance of the XO player piece so that the line of scrimmage marker lands exactly on or beyond the goal line it is considered a score. After a score, increase the value on the HOME or AWAY score dial, reset the XO player piece to the opposite 20 yard line, and the other player starts the next series.
9. CHALLENGES: if the two players cannot agree on the location of the game piece and what area it is in, one player can call for a challenge. Whoever calls for a challenge gets to flip a coin, the other calls "heads" or "tails", and move on with the game play. Each player is allowed two challenges per game.
10. FIELD GOALS: For all field goal attempts, the offensive player simply lets the defensive player know verbally that a field goal is going to be attempted. There are no field goals longer than 50 yards and there is no need to back up the game piece seven yards for kicker placement. However, 10 yards must be added to the distance from the LINE OF SCRIMMAGE to the goal line to determine the length of field goal needed.

(Ex. If the offensive player is on the 35 yard line, then he is attempting a 45 yard field goal, and thus must score with the 50 yard FG target.).

Only the three center targets are used for scoring field goals, and landing within a certain target results in a successful attempt for any distance up to that indicated yard amount.

(For instance, if the offensive player is attempting a 28 yard field goal, but lands in the FG/40 yard target, the field goal is still good)
11. PUNT: For all punts, the offensive player simply lets the defensive player know verbally that he wants to punt. All "punts" are assumed to be 40 yards from the LINE OF SCRIMMAGE. Simply move the XO Player Piece 40 yards and the defensive team takes over. If the offense is on the 39 yard line, or within, of the opposing team's side of the field, then the punt is assumed to be a touchback and the XO player piece is placed on the 20 yard line and the defensive team takes over.
12. "BLOCK" OR "BLITZ" option (for advanced game play): Only when the defensive player chooses the same RUN/PASS type of play on the down as the offensive player's selection, the defensive player may choose to "Block" OR "Blitz" on the attempt.

To attempt a block, prior to the offensive player's attempt on the down, the defensive player, using the same RUN puck or PASS game piece as the type of play selected, may place one game piece anywhere behind the line of scrimmage in an attempt to discourage or block the offensive player from a certain area.

To attempt a blitz, at the approximate same time as the offensive player's attempt on the down, using the same RUN game piece or PASS game piece as the type of play selected, the defensive player may choose to push the game piece down to the opposite end of the board in an attempt to land the game piece in one of the "TURNOVER ZONES". The success and outcome of the blitz is based on the following:

a) If Offense scores yards and Defense lands in Turnover Zone, 0 yards are awarded.
   b) If Offense scores yards and Defense misses Turnover Zone, 2X yards are awarded to Offense.
   c) If Offense lands in an empty space and Defense lands in Turnover Zone, a sack of −5 yards is awarded to the Defense.
   d) If Offense lands in an empty space and Defense misses Turnover Zone, 0 yards are awarded.
   e) If Offense lands in a Turnover Zone, and Defense lands in a Turnover Zone, a Turnover results.
   f) If Offense lands in a Turnover Zone, and Defense misses the Turnover Zone, NO Turnover occurs and 0 yards are awarded.
   g) If Offense lands in a Sack Zone, and Defense lands in a Turnover Zone, a sack of −10 yards is awarded to the Defense.
   h) If Offense lands in a Sack Zone, and Defense misses the Turnover Zone, a sack of −5 yards is awarded to the Defense.

If the defender hits the offensive player's game piece, it is a "penalty" and the offense is awarded 10 yards. (Note: the defensive player is allowed to hesitate slightly, until the offensive player has slid his game piece, but must choose to blitz or not, before the offensive player's game piece reaches his side of the table).

As indicated above, although the rules described above cover basic conventions for play according to embodiments of the invention, other additions, modifications, and/or substitutions are possible without departing from the scope and spirit of embodiments of the invention.

It is understood that the illustrations of the present invention are by way of example and not by way of limitation, and the scope of the invention is not limited to the exact details shown or described. Potential modifications and alterations may occur to others upon a reading and understanding of this disclosure, and it is understood that the invention includes all such modifications and alterations and equivalents thereof.

In the foregoing description, certain terms have been used for brevity, clearness, understanding, and by way of example, but no unnecessary limitations are to be implied therefrom beyond the requirements of the prior art, because such terms are used for descriptive purposes and are intended to be broadly construed.

I claim:

1. A tabletop sporting game apparatus, comprising:

a table having a game board, wherein the game board includes a plurality of yardage targets disposed thereon;

a simulated American football field piece secured to the table;

at least two play-indicating mechanisms attached to the table, wherein the at least two play-indicating mechanisms are each configured to be manipulated by a player to represent a selection, by the player, of one of a plurality of play options, the plurality of play options comprising at least a run play and a pass play, each of said at least two play-indicating mechanisms being configured to selectively display or conceal said selection; and at least one game piece configured to represent an American football, wherein each of the plurality of yardage targets represents a number of yards that a player gains or loses as a result of causing the at least one game piece to contact the respective yardage target.

2. The tabletop sporting game apparatus of claim 1, wherein the simulated American football field piece is disposed above the game board such that the at least one game piece may pass underneath the simulated American football field piece.

3. The tabletop sporting game apparatus of claim 1, wherein the simulated American football field piece is disposed within the game board such that the at least one game piece may pass over the simulated American football field piece.

4. The tabletop sporting game apparatus of claim 3, the game board comprising a recess, and wherein the simulated American football field piece is disposed within the recess.

5. The tabletop sporting game apparatus of claim 1, wherein the simulated American football field piece comprises a base and a field component disposed within the base.

6. The tabletop sporting game apparatus of claim 5, wherein the field component of the American football field piece is configured to be removed from the base to allow for replacement with an alternate field component.

7. The tabletop sporting game apparatus of claim 1, the plurality of yardage targets comprising a plurality of upright targets affixed to the game board, wherein each of said upright targets represents an outcome based on an outcome that can result from an event in an American football game, the outcome comprising at least one of a number of yards gained and a number of yards lost.

8. The tabletop sporting game apparatus of claim 1, further comprising a simulated American football yard marker slideably coupled to the simulated American football field piece.

9. The tabletop sporting game apparatus of claim 1, further comprising a scoreboard coupled to the simulated American football field piece or to the game board.

10. The tabletop sporting game apparatus of claim 1, further comprising a down marker slideably coupled to the simulated American football field piece or to the game board.

11. The tabletop sporting game apparatus of claim 1, further comprising a simulated American football line of scrimmage marker slideably coupled to the simulated American football field piece.

12. The tabletop sporting game apparatus of claim 1, further comprising a plurality of scoring targets disposed on the game board, wherein each of the plurality of scoring targets represents a scoring outcome that can occur in an American football game, the scoring outcome comprising a number of points corresponding to a field goal.

13. The tabletop sporting game apparatus of claim 1, further comprising a plurality of zones, wherein each of said plurality of zones represents a defensive outcome that can occur in an American football game, wherein the defensive outcome comprises at least one of a turnover, a sack, an interception, and a safety.

14. A tabletop sporting game apparatus, comprising:

a table having a game board and an underside, wherein the game board includes a plurality of yardage targets disposed thereon;

at least two play-indicating mechanisms attached to the table, wherein the at least two play-indicating mechanisms are each configured to be manipulated by a player to allow the player to select one of a plurality of play options, the plurality of play options comprising at least a run play and a pass play, each of the at least two play-indicating mechanisms comprising a cover slide configured to be used to selectively cover the run selection or the pass selection; and at least one game piece configured to represent an American football, wherein each of the plurality of yardage targets represents a number of yards that a player gains or loses as a result of causing the at least one game piece to contact the respective yardage target; and wherein the plurality of yardage targets comprises yardage targets having different sizes so as to create different degrees of difficulty in contacting the targets with the at least one game piece.

15. The tabletop sporting game apparatus of claim 14, wherein the simulated American football field piece comprises a base and a field component disposed within the base, wherein the field component is configured to be removed from the base to allow for replacement with an alternate field component.

16. The tabletop sporting game apparatus of claim 14, further comprising a plurality of scoring targets disposed on the game board, wherein each of the plurality of scoring targets represents a scoring outcome that can occur in an American football game, the scoring outcome comprising a number of points corresponding to a field goal.

17. The tabletop sporting game apparatus of claim 16, wherein at least one of a yardage target of the plurality of yardage targets and a scoring target of the plurality of scoring targets comprises an upright target affixed to the game board.

18. The tabletop sporting game apparatus of claim 14, further comprising a plurality of zones disposed on the game board, wherein each of the plurality of zones represents a defensive outcome that can occur in an American football game, the defensive outcome comprising at least one of turnover, a sack, an interception, and a safety.

19. A tabletop sporting game apparatus, comprising:

a table having a game board and an underside, wherein the game board includes a plurality of targets and a plurality of zones marked thereon;

a simulated American football field piece secured to the table, the simulated American football field piece designed to represent an American football field and configured to be used as a device for tracking at least one of yardage gained, yardage lost, scores, downs, and/or field positions;

at least two play-indicating mechanisms attached to the table, wherein the at least two play-indicating mechanisms are each configured to be manipulated by a player to allow the player to select one of a plurality of play options, the plurality of play options comprising at least a run play and a pass play, each of said at least two play-indicating mechanisms being configured to selectively display or conceal said selection; and at least one game piece configured to represent an American football;

wherein each of the plurality of targets represents an offensive outcome that occurs in response to the at least one game piece contacting the respective target, the outcome corresponding to an offensive outcome that can occur in an American football game, the offensive outcome comprising at least one of a number of yards gained, a number of yards lost, and a number of points corresponding to a field goal; and wherein each of the plurality of zones represents a defensive outcome that occurs in response to the at least one game piece contacting the respective zone, the defensive outcome corresponding to a defensive outcome that can occur in an American football game, the defensive outcome comprising at least one of a turnover, a sack, an interception, and a safety.

20. The tabletop sporting game apparatus of claim 19, wherein the simulated American football field piece comprises a base and a field component disposed within the base, and wherein the field component of the American football field piece is configured to be removed from the base to allow for replacement with an alternate field component.

* * * * *